US008396707B2

(12) United States Patent
Vaillancourt et al.

(10) Patent No.: US 8,396,707 B2
(45) Date of Patent: Mar. 12, 2013

(54) METHOD AND DEVICE FOR EFFICIENT QUANTIZATION OF TRANSFORM INFORMATION IN AN EMBEDDED SPEECH AND AUDIO CODEC

(75) Inventors: Tommy Vaillancourt, Sherbrooke (CA); Redwan Salami, Ville St-Laurent (CA)

(73) Assignee: VoiceAge Corporation, Québec (CA)

( * ) Notice: Subject to any disclaimer, the term of this patent is extended or adjusted under 35 U.S.C. 154(b) by 347 days.

(21) Appl. No.: 12/676,399

(22) PCT Filed: Sep. 25, 2008

(86) PCT No.: PCT/CA2008/001700

§ 371 (c)(1),
(2), (4) Date: May 20, 2010

(87) PCT Pub. No.: WO2009/039645

PCT Pub. Date: Apr. 2, 2009

(65) Prior Publication Data

US 2010/0292993 A1 Nov. 18, 2010

Related U.S. Application Data

(60) Provisional application No. 60/960,431, filed on Sep. 28, 2007.

(51) Int. Cl.
*G10L 19/00* (2006.01)

(52) U.S. Cl. ..... 704/220; 704/200.1; 704/219; 704/230

(58) Field of Classification Search ..... 704/200, 704/200.1, 201, 220, 221, 222, 223, 230
See application file for complete search history.

(56) References Cited

U.S. PATENT DOCUMENTS

| | | | | |
|---|---|---|---|---|
| 5,774,844 | A * | 6/1998 | Akagiri | 704/230 |
| 6,098,039 | A * | 8/2000 | Nishida | 704/229 |
| 6,449,596 | B1 * | 9/2002 | Ejima | 704/501 |
| 6,658,382 | B1 * | 12/2003 | Iwakami et al. | 704/224 |
| 7,110,941 | B2 | 9/2006 | Li | |
| 7,272,556 | B1 * | 9/2007 | Aguilar et al. | 704/230 |
| 2002/0049583 | A1 * | 4/2002 | Bruhn et al. | 704/203 |
| 2002/0072904 | A1 * | 6/2002 | Chen | 704/230 |
| 2002/0116177 | A1 * | 8/2002 | Bu et al. | 704/200.1 |
| 2004/0184537 | A1 | 9/2004 | Geiger et al. | |
| 2005/0091040 | A1 * | 4/2005 | Nam et al. | 704/201 |
| 2005/0163323 | A1 | 7/2005 | Oshikiri | |

(Continued)

OTHER PUBLICATIONS

Johnston, "Transform Coding of Audio Signals Using Perceptual Noise Criteria", IEEE Journal on Selected Areas in Communication, vol. 6, No. 2, Feb. 1988, pp. 314-323.

(Continued)

*Primary Examiner* — Jesse Pullias
(74) *Attorney, Agent, or Firm* — Fay Kaplun & Marcin, LLP

(57) ABSTRACT

A method and device for coding an input sound signal in at least one lower layer and at least one upper layer of an embedded codec comprises, in the at least one lower layer, coding the input sound signal to produce coding parameters, wherein coding the input sound signal comprises producing a synthesized sound signal. An error signal is computed as a difference between the input sound signal and the synthesized sound signal and a spectral mask is calculated as a function of a minima of a spectrum related to the input sound signal. In the at least one upper layer, the error signal is coded to produce coding coefficients, the spectral mask is applied to the coding coefficients, and the masked coding coefficients are quantized. Applying the spectral mask to the coding coefficients reduces the quantization noise produced upon quantizing the coding coefficients.

31 Claims, 8 Drawing Sheets

U.S. PATENT DOCUMENTS

2007/0016427 A1 1/2007 Thumpudi et al.
2007/0208557 A1 9/2007 Li et al.

OTHER PUBLICATIONS

Recommendation ITU-T G.729: Coding of Speech at 8 kbits/s Using Conjugate-Structure Alegebraic-Code-Excited Linear Prediction (CS-ACELP), 1 sheet, Mar. 1996.

ITU-T Recommendation G.718 Series G: Transmission Systems and Media, Digital Systems and Networks, Digital Terminal Equipments—Coding of Voice and Audio Signals, "Frame Error Robust Narrowband and Wideband Embedded Variable Bit-Rate Coding of Speech and Audio from 8-32 kbit/s", 2008, 259 sheets.

International Telecommunication Union, Telecommunication Standardization Sector, COM 16-C 199 R1-E, Jun. 2007, Study Period 2005-2008, 13 sheets.

Recommendation ITU-T G.729.1:ITU G. 729 Based Embedded Variable Bit-Rate Coder: An 8-32 kbit/s, Scalable Wideband, Coder-Bitstream Interoperable with ITU-T G.729 Codecs, 1 sheet, May 2006.

* cited by examiner

METHOD AND DEVICE FOR EFFICIENT QUANTIZATION OF TRANSFORM INFORMATION IN AN EMBEDDED SPEECH AND AUDIO CODEC

FIELD

The present invention relates to encoding of sound signals (for example speech and audio signals) using an embedded (or layered) coding structure.

More specifically, but not exclusively, in an embedded codec where linear prediction based coding is used in the lower (or core) layers and transform coding used in the upper layers, a spectral mask is computed based on a spectrum related to the input sound signal and applied to the transform coefficients in order to reduce the quantization noise of the transform-based upper layers.

BACKGROUND

In embedded coding, also known as layered coding, the sound signal is encoded in a first layer to produce a first bit stream, and then the error between the original sound signal and the encoded signal (synthesis sound signal) from the first layer is further encoded to produce a second bit stream. This can be repeated for more layers by encoding the error between the original sound signal and the synthesis sound signal from all preceding layers. The bit streams of all layers are concatenated for transmission. The advantage of layered coding is that parts of the bit stream (corresponding to upper layers) can be dropped in the network (e.g. in case of congestion) while still being able to decode the encoded sound signal at the receiver depending on the number of received layers. Layered coding is also useful in multicast applications where the encoder produces the bit stream of all layers and the network decides to send different bit rates to different end points depending on the available bit rate within each link.

Embedded or layered coding can be also useful to improve the quality of widely used existing codecs while still maintaining interoperability with these codecs. Adding layers to the standard codec lower (or core) layer can improve the quality and even increase the encoded audio signal bandwidth. An example is the recently standardized ITU-T Recommendation G.729.1 in which the lower (or core) layer is interoperable with the widely used narrowband ITU-T Recommendation G.729 operating at 8 kbit/s. The upper layers of ITU-T Recommendation G.729.1 produce bit rates up to 32 kbit/s (with wideband signal starting from 14 kbit/s). Current standardization work aims at adding mode layers to produce super wideband (14 kHz bandwidth) and stereo extensions. Another example is Recommendation G.718 recently approved by ITU-T [1] for encoding wideband signals at 8, 12, 16, 24, and 32 kbit/s. This codec was previously known as EV-VBR codec and was undertaken by Q9/16 in ITU-T. In the following description, reference to EV-VBR shall mean reference to ITU-T Recommendation G.718. The EV-VBR codec is also envisaged to be extended to encode super wideband and stereo signals at higher bit rates. As a non-limitative example, the EV-VBR codec will be used in the non-restrictive, illustrative embodiments of the present invention since the technique disclosed in the present disclosure is now part of ITU-T Recommendation G.718.

The requirements for embedded codecs usually comprise good quality in case of both speech and audio signals. Since speech can be encoded at relatively low bit rate using a model-based approach, the lower layer (or first two lower layers) is encoded using a speech specific technique and the error signal for the upper layers is encoded using a more generic audio coding technique. This approach delivers a good speech quality at low bit rates and a good audio quality as the bit rate increases. In the EV-VBR codec (and also in ITU-T Recommendation G.729.1), the two lower layers are based on the ACELP (algebraic code-excited linear prediction) technique which is suitable for encoding speech signals. In the upper layers, transform-based coding suitable for audio signals is used to encode the error signal (the difference between the input sound signal and the output (synthesized sound signal) from the two lower layers). In the upper layers, the well known MDCT transform is used, where the error signal is transformed into the frequency domain using windows with 50% overlap. The MDCT coefficients can be quantized using several techniques, for example scalar quantization with Hoffman coding, vector quantization, or any other technique. In the EV-VBR codec, algebraic vector quantization (AVQ) is used to quantize the MDCT coefficients among other techniques.

The spectrum quantizer has to quantize a range of frequencies with a maximum amount of bits. Usually the amount of bits is not high enough to quantize perfectly all frequency bins. The frequency bins with highest energy are quantized first (where the weighted spectral error is higher), then the remaining frequency bins are quantized, if possible. When the amount of available bits is not sufficient, the lowest energy frequency bins are only roughly quantized and the quantization of these lowest energy frequency bins may vary from one frame to the other. This rough quantization leads to an audile quantization noise especially between 2 kHz and 4 kHz. Accordingly, there is a need for a technique for reducing the quantization noise caused by a lack of bits to quantize all energy frequency bins in the spectrum or by too large a quantization step.

SUMMARY

According to the present invention, there is provided a method for coding an input sound signal in at least one lower layer and at least one upper layer of an embedded codec, the method comprising: in the at least one lower layer, (a) coding the input sound signal to produce coding parameters, wherein coding the input sound signal comprises producing a synthesized sound signal; computing an error signal as a difference between the input sound signal and the synthesized sound signal; calculating a spectral mask from a spectrum related to the input sound signal; in the at least one upper layer, (a) coding the error signal to produce coding coefficients, (b) applying the spectral mask to the coding coefficients, and (c) quantizing the masked coding coefficients; wherein applying the spectral mask to the coding coefficients reduces the quantization noise produced upon quantizing the coding coefficients.

The present invention also relates to a method for reducing a quantization noise produced during coding of an error signal in at least one upper layer of an embedded codec, wherein coding the error signal comprises producing coding coefficients and quantizing the coding coefficients, and wherein the method comprises: providing a spectral mask; and in the at least one upper layer, applying the spectral mask to the coding coefficients prior to quantizing the coding coefficients.

Also in according with the present invention, there is provided a device for coding an input sound signal in at least one lower layer and at least one upper layer of an embedded codec, the device comprising: in the at least one lower layer, (a) means for coding the input sound signal to produce coding parameters, wherein the sound signal coding means produces a synthesized sound signal; means for computing an error signal as a difference between the input sound signal and the synthesized sound signal; means for calculating a spectral mask from a spectrum related to the input sound signal; in the at least one upper layer, (a) means for coding the error signal to produce coding coefficients, (b) means for applying the spectral mask to the coding coefficients, and (c) means for quantizing the masked coding coefficients; wherein applying the spectral mask to the coding coefficients reduces the quantization noise produced upon quantizing the coding coefficients.

The present invention further relates to a device for coding an input sound signal in at least one lower layer and at least one upper layer of an embedded codec, the device comprising: in the at least one lower layer, (a) a sound signal codec for coding the input sound signal to produce coding parameters, wherein the sound signal sound signal codec produces a synthesized sound signal; a subtractor for computing an error signal as a difference between the input sound signal and the synthesized sound signal; a calculator of a spectral mask from a spectrum related to the input sound signal; in the at least one upper layer, (a) a coder of the error signal to produce coding coefficients, (b) a modifier of the coding coefficients by applying the spectral mask to the coding coefficients, and (c) a quantizer of the masked coding coefficients; wherein applying the spectral mask to the coding coefficients reduces the quantization noise produced upon quantizing the coding coefficients.

Still further in accordance with the present invention, there is provided a device for reducing a quantization noise produced during coding of an error signal in at least one upper layer of an embedded codec, wherein coding the error signal comprises producing coding coefficients and quantizing the coding coefficients, and wherein the device comprises: a spectral mask; and in the at least one upper layer, a modifier of the coding coefficients by applying the spectral mask to the coding coefficients prior to quantizing the coding coefficients.

The foregoing and other objects, advantages and features of the present invention will become more apparent upon reading of the following non-restrictive description of illustrative embodiments thereof, given by way of example only with reference to the accompanying drawings.

BRIEF DESCRIPTION OF THE DRAWINGS

In the appended drawings.

DETAILED DESCRIPTION

In the following non-restrictive description, a technique to reduce the quantization noise caused by a lack of bits to quantize all energy frequency bins in the spectrum or by too large a quantization step is disclosed. More specifically, to reduce the quantization noise, a spectral mask is computed and applied to transform coefficients before quantization. The spectral mask is generated in relation with a spectrum related to the input sound signal. The spectral mask corresponds to a set of scaling factors applied to the transform coefficients before the quantization process. The spectral mask is computed in such a manner that the scaling factors are larger (close to 1) in the region of the maxima of the spectrum of the input sound signal and smaller (as low as 0.15) in the region of the minima of the spectrum of the input sound signal. The reason is that the quantization noise resulting from the upper layers in the case of input speech signals is usually located between formants. These formants need to be identified to create the appropriate spectral mask. By lowering the value of the energy of the frequency bins in the spectral regions corresponding to the minima of the spectrum of the input sound signal (between the formants in the case of speech signals), the resulting quantization noise will be lowered when the amount of bits available is insufficient for full quantization.

This procedure results in a better quality in the case of speech signals, when the lower (or core) layers are quantized using a speech-specific coding technique and the upper layers are quantized using transform-based techniques.

In summary, the disclosed technique forces the quantizer to use its bit budget in the region of the formants instead of between them. To achieve this goal, a first step uses the spectrum of the input sound signal available at the encoder in the lower layers or the spectral response of a mask filter derived, for example, from LP (linear prediction) parameters also available at the encoder in the lower layers to identify a formant shape. In a second step, maxima and minima inside the spectrum of the input sound signal are identified (corresponding to spectral peaks and valleys). In a third step, the maxima and minima location information is used to generate a spectral mask. In a fourth step, the currently calculated spectral mask, which may be a newly calculated spectral mask or an updated version of previously calculated spectral mask(s), is applied to the transform (for example MDCT) coefficients (or spectral error to be quantized) to reduce the quantization noise due to spectral error between formants.

Figure 1:
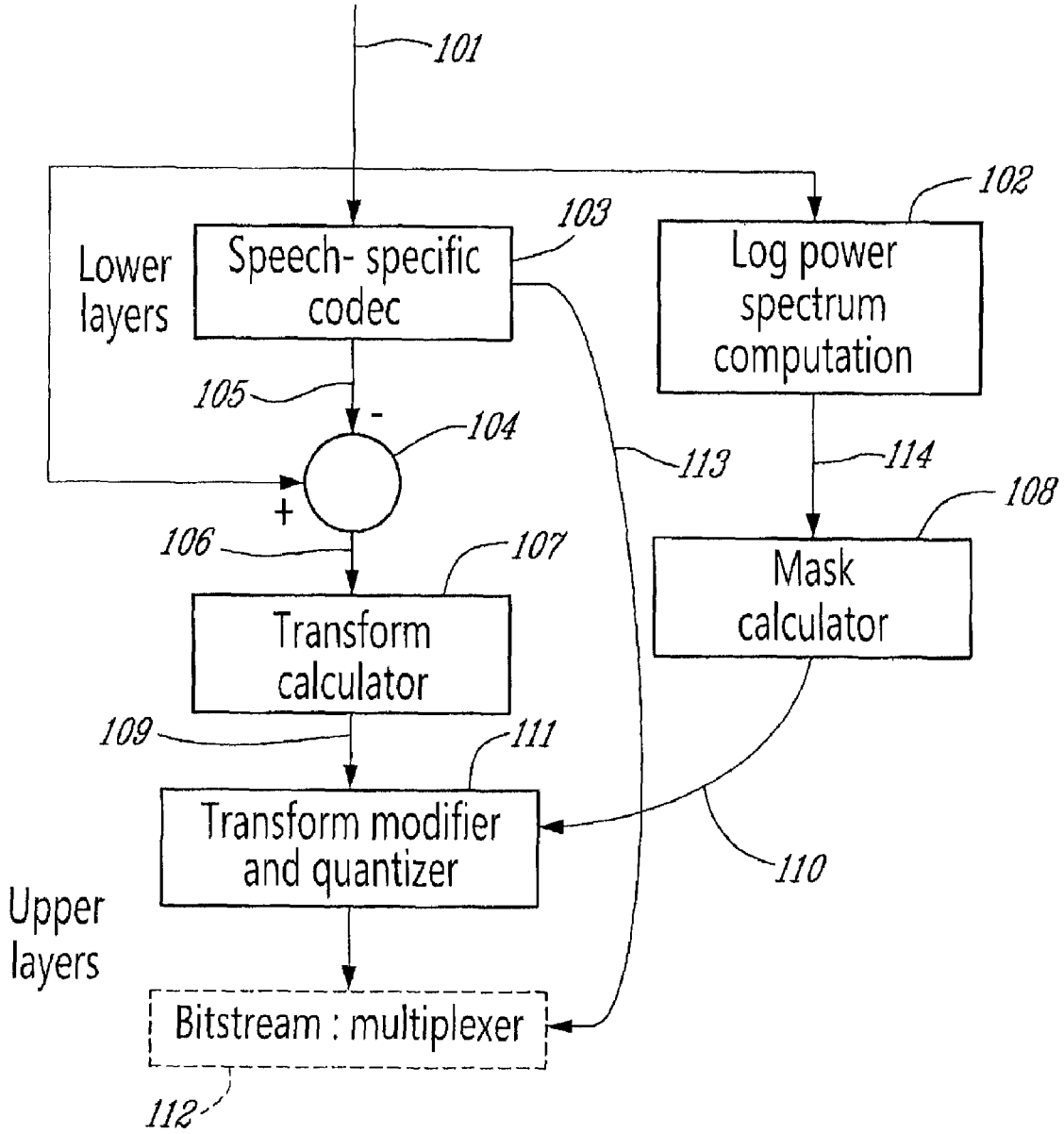
FIG. 1 is a schematic block diagram of a non-restrictive illustrative embodiment of the method and device according to the present invention, for coding an input sound signal in at least one lower layer and at least one upper layer of an embedded codec while reducing a quantization noise.

FIG. 1 is a schematic block diagram of a non-restrictive illustrative embodiment of the method and device according to the present invention, for coding an input sound signal in at least one lower layer and at least one upper layer of an embedded codec while reducing a quantization noise.

Referring to FIG. 1, an input sound signal 101 is coded in two or more layers. It should be noted that the sound signal 101 can be a pre-processed input signal.

In the lower layer or layers, i.e. in the at least one lower layer, the spectrum, for example the power spectrum of the input sound signal 101 in the log domain is computed through a log power spectrum calculator 102. The input sound signal 101 is also coded through a speech specific codec 103 to produce coding parameters 113. The speech specific coded 103 also produces a synthesized sound signal 105.

A subtractor 104 then computes an error signal 106 as the difference between the input sound signal 101 and the synthesized sound signal 105 from the lower layer(s), more specifically from the speech specific codec 103.

In the upper layer or layers, i.e. in the at least one upper layer, a transform is used. More specifically, the transform calculator 107 applies a transform to the error signal 106.

A spectral mask calculator 108 then computes a spectral mask 110 based on the power spectrum 114 of the input sound signal 101 in the log domain as calculated by the log power spectrum calculator 102.

A transform modifier and quantizer 111 (a) applies the spectral mask 110 to the transform coefficients 109 as calculated by the transform calculator 107 and (b) then quantizes the masked transform coefficients.

A bit stream 112 is finally constructed, for example through a multiplexer, and comprises the lower layer(s) including coding parameters 113 from the speech specific codec 103 and the upper layer(s) including the transform coefficients 110 as masked and quantized by the transform modifier and quantizer 111.

Figure 2:
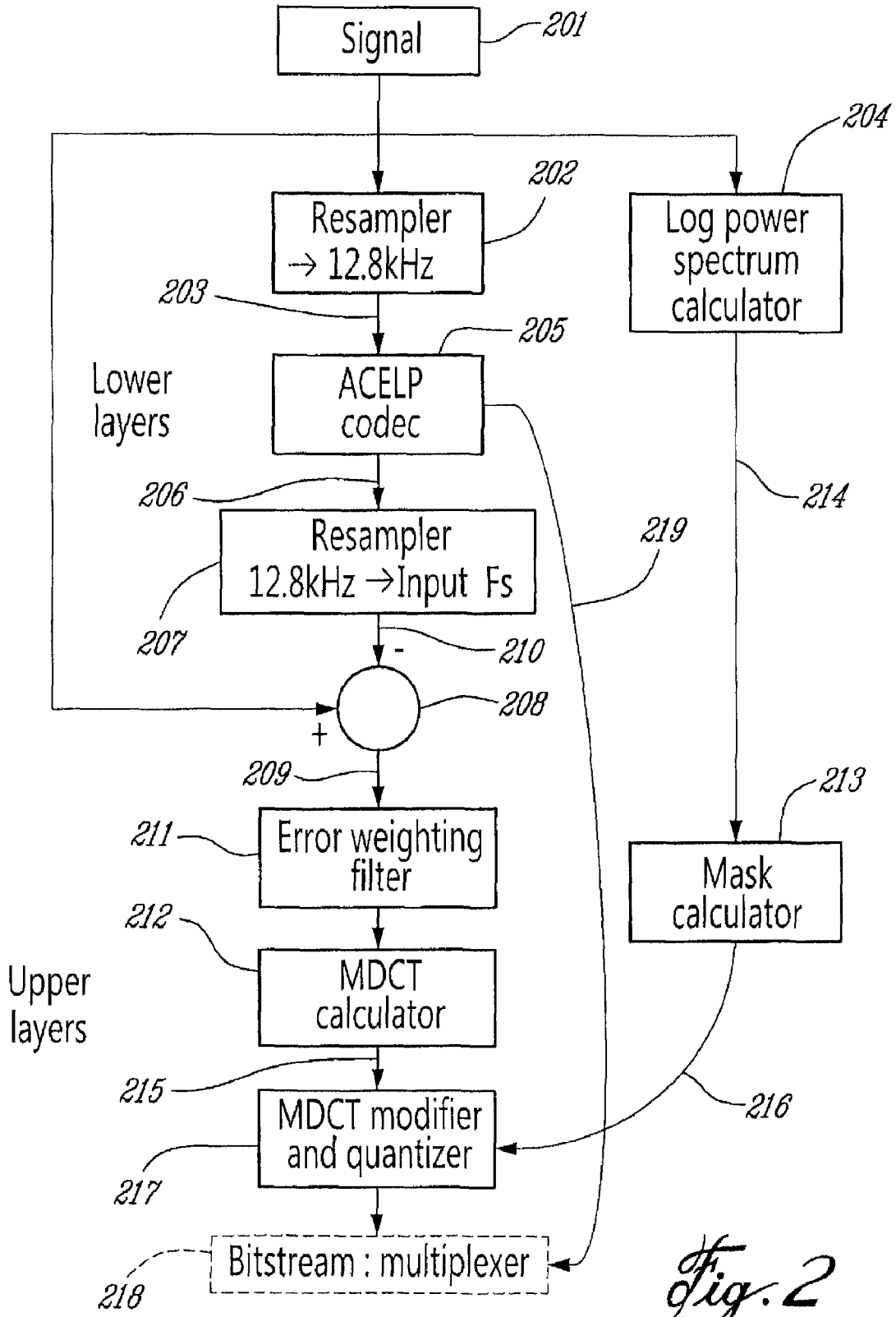
FIG. 2 is a schematic block diagram of a non-restrictive illustrative embodiment of the method and device according to the present invention, for coding an input sound signal in at least one lower layer and at least one upper layer of an embedded codec while reducing a quantization noise, in the context of an EV-VBR codec, wherein an internal sampling frequency of 12.8 kHz is used for coding the lower layers.

FIG. 2 is a schematic block diagram of a non-restrictive illustrative embodiment of the method and device according to the present invention, for coding an input sound signal in at least one lower layer and at least one upper layer of an embedded codec while reducing a quantization noise, in the context of an EV-VBR codec, wherein an internal sampling frequency of 12.8 kHz is used for coding the lower layer(s).

Referring to FIG. 2, an input sound signal 201 is coded in two or more layers.

In the lower layer or layers, i.e. in the at least one lower layer, a resampler 202 resamples the input sound signal 201, originally sampled at a first input sampling frequency usually of 16 kHz, at a second sampling frequency of 12.8 kHz. The spectrum, for example the power spectrum of the resampled sound signal 203 in the log domain is computed through a log power spectrum calculator 204. The resampled sound signal 203 is also coded through a speech specific ACELP codec 205 to produce coding parameters 219.

The speech specific ACELP coded 205 also produces a synthesized sound signal 206. This synthesized sound signal 206 from the lower layer(s), i.e. from the speech specific ACELP codec 205 is resampled back at the first input sampling frequency (usually 16 kHz) by a resampler 207.

A subtractor 208 then computes an error signal 209 corresponding to the difference between the original sound signal 201 and the resampled, synthesized sound signal 210 from the lower layer(s), more specifically from the speech specific ACELP codec 205 and resampler 207.

In the upper layer(s), the error signal 209 is first weighted with a perceptual weighting filter 211 (similar to the perceptual weighting filter used in ACELP), and is then transformed using MDCT (Modified Discrete Cosine Transform) in a calculator 212 to produce MDCT coefficients 215.

A spectral mask calculator 213 then computes a spectral mask 216 based on the power spectrum 214 of the resampled input signal 203 in the log domain as calculated by the log power spectrum calculator 204.

A MDCT modifier and quantizer 217 applies the spectral mask 216 as calculated by the spectral mask calculator 213 to the MDCT coefficients 215 from the MDCT calculator 212 and quantizes the masked MDCT coefficients 216.

A bit stream 218 is finally constructed, for example through a multiplexer, and comprises the lower layer(s) including coding parameters 219 from the speech specific ACELP codec 205 and the upper layer(s) including the MDCT coefficients 220 as masked and quantized through the MDCT modifier and quantizer 217.

In the following description, two non-restrictive illustrative embodiments are disclosed to illustrate the computation of the spectral mask applied to the frequency bins before quantization. It is within the scope of the present invention to use any other suitable methods for calculating the spectral mask without departing from the scope of the present invention. These two illustrative embodiments will be explained in the context of the EV-VBR codec. In the ACELP two lower layers, the EV-VBR codec operates at an internal sampling frequency of 12.8 kHz. This EV-VBR codec also uses 20 ms frames corresponding to 256 samples at a sampling frequency of 12.8 kHz.

Mask Computation Based on the Spectrum of the Original Input Sound Signal

Figure 7:
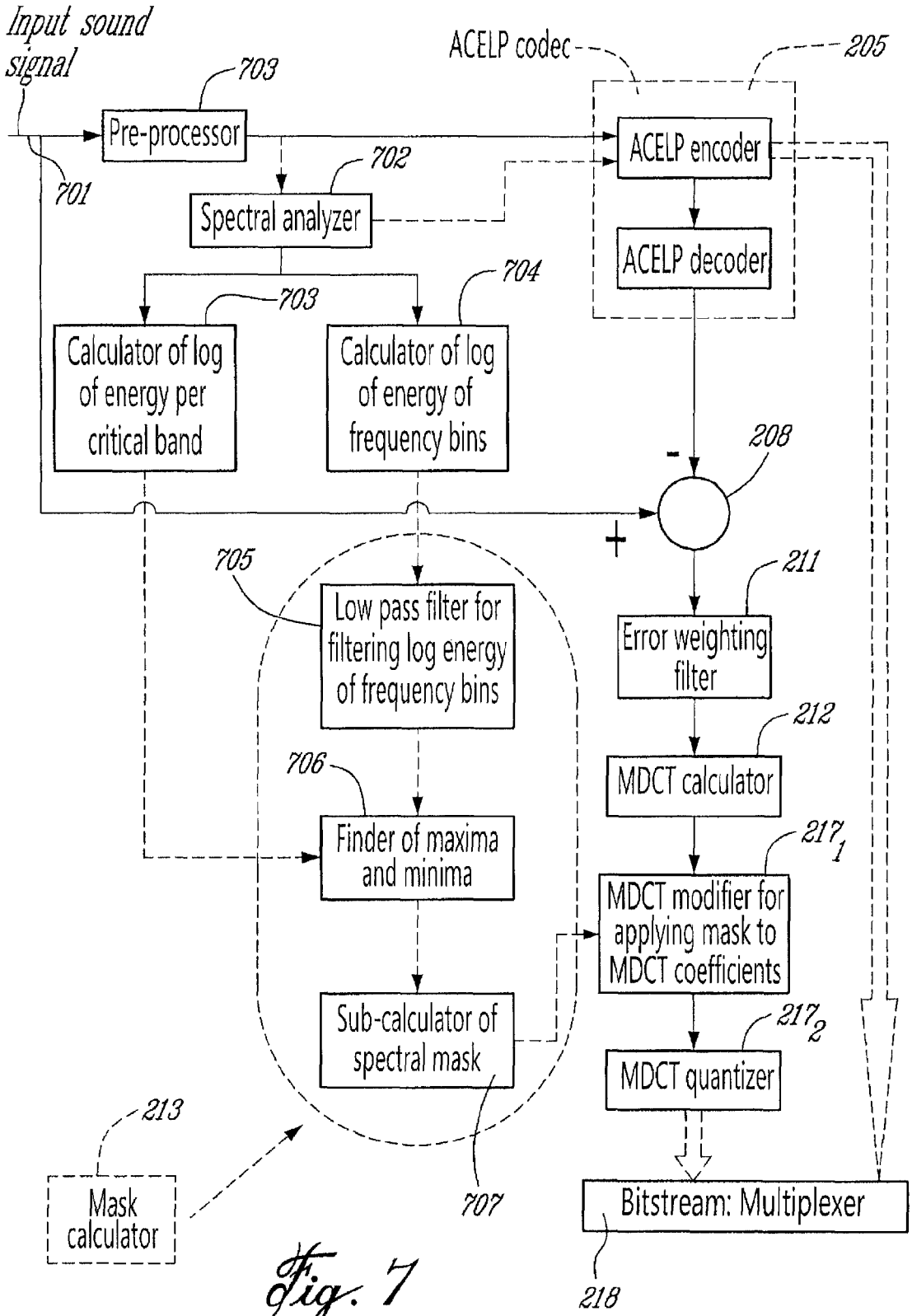
FIG. 7 is a schematic block diagram of a first illustrative embodiment of a technique for calculating and applying a spectral mask to transform coefficients in the upper layers.

FIG. 7 is a schematic block diagram of an illustrative embodiment of a method and device for coding an input sound signal in at least one lower layer and at least one upper layer of an embedded codec while reducing a quantization noise, including calculating and applying a spectral mask to transform coefficients in the upper layer(s). In the block diagram of FIG. 7, the elements corresponding to FIG. 2 are identified using the same reference numerals.

In the illustrative embodiment as illustrated in FIG. 7, the spectral mask is computed based on the spectrum, for example the power spectrum of the input sound signal 701. In the EV-VBR codec, a spectral analyser 702 performs a spectral analysis on the input sound signal 701, after pre-processing through a pre-processor 703 for the purpose of noise reduction [1]. The result of the spectral analysis is used to compute the spectral mask.

Figure 3:
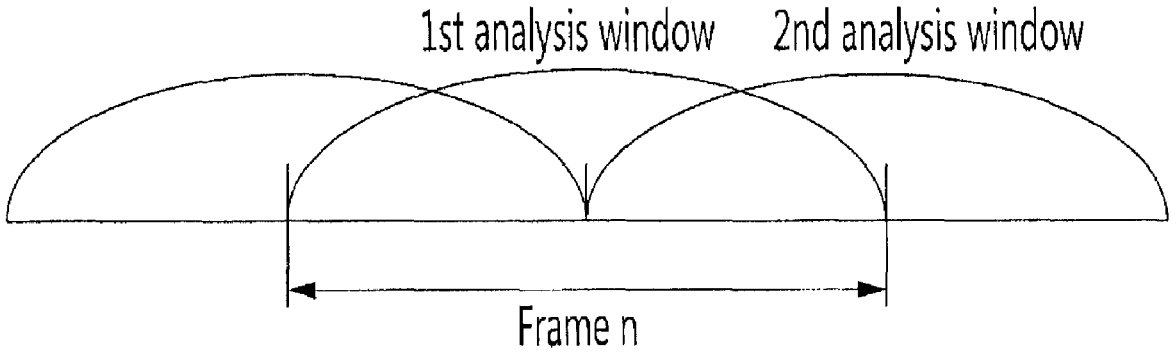
FIG. 3 is a graph illustrating an example of 50% overlap windowing in spectral analysis.

In the spectral analyser 702, a discrete Fourier Transform is used to perform the spectral analysis and spectrum energy estimation in view of calculating the power spectrum of the input sound signal 701. The frequency analysis is done twice per frame using a 256-points Fast Fourier Transform (FFT) with a 50 percent overlap as illustrated in FIG. 3. A square root of a Hanning window (which is equivalent to a sine window) is used to weight the input sound signal for the frequency analysis. This window is particularly well suited for overlap-add methods. The square root Hanning window is given by the relation:

$$w_{FFT}(n) = \sqrt{0.5 - 0.5\cos\left(\frac{2\pi n}{L_{FFT}}\right)} = \sin\left(\frac{\pi n}{L_{FFT}}\right), \quad n = 0, \ldots, L_{FFT} - 1 \tag{1}$$

where $L_{FFT}=256$ is the size of the FFT (Fast Fourier Transform) analysis. It should be pointed out that only half the window is computed and stored since it is symmetric (from 0 to $L_{FFT}/2$).

Let s'(n) denote the input sound signal with index 0 corresponding to the first sample in the frame. The windowed signal for both spectral analysis are obtained using the following relation:

$$x_w^{(1)}(n)=w_{FFT}(n)s'(n), n=0, \ldots, L_{FFT}-1$$

$$x_w^{(2)}(n)=w_{FFT}(n)s'(n+L_{FFT}/2), n=0, \ldots, L_{FFT}-1 \tag{2}$$

where s'(0) is the first sample in the current frame.

FFT is performed on both windowed signals as follows to obtain two sets of spectral parameters per frame:

$$X^{(1)}(k) = \sum_{n=0}^{N-1} x_w^{(1)}(n) e^{-j2\pi\frac{kn}{N}}, \quad k = 0, \ldots, L_{FFT} - 1 \tag{3}$$

$$X^{(2)}(k) = \sum_{n=0}^{N-1} x_w^{(2)}(n) e^{-j2\pi\frac{kn}{N}}, \quad k = 0, \ldots, L_{FFT} - 1$$

where N is the number of samples per frame.

The output of the FFT gives the real and imaginary parts of the power spectrum denoted by $X_R(k)$, k=0 to 128, and $X_I(k)$, k=1 to 127. Note that $X_R(0)$ corresponds to the spectrum at 0 Hz (DC) and $X_R(128)$ corresponds to the power spectrum at 6400 Hz (EV-VBR uses a 12.8 kHz internal sampling frequency). The power spectrum at these points is only real valued and usually ignored in the subsequent analysis.

After FFT analysis, a calculator 703 of the energy per critical band in the log domain divides the resulting spectrum into critical frequency bands using the intervals having the following upper limits [2] (20 bands in the frequency range 0-6400 Hz):

Critical bands={100.0, 200.0, 300.0, 400.0, 510.0, 630.0, 770.0, 920.0, 1080.0, 1270.0, 1480.0, 1720.0, 2000.0, 2320.0, 2700.0, 3150.0, 3700.0, 4400.0, 5300.0, 6350.0} Hz.

The 256-point FFT results in a frequency resolution of 50 Hz (6400/128). Thus after ignoring the DC component of the spectrum, the number of frequency bins per critical band is $M_{CB}$={2, 2, 2, 2, 2, 2, 3, 3, 3, 4, 4, 5, 6, 6, 8, 9, 11, 14, 18, 21}, respectively.

The calculator 703 computes the average energies of the critical bands using the following relation:

$$E_{CB}(i) = \frac{1}{(L_{FFT}/2)^2 M_{CB}(i)} \sum_{k=0}^{M_{CB}(i)-1} (X_R^2(k + j_i) + X_I^2(k + j_i)), \quad i = 0, \ldots, 19 \tag{4}$$

where $X_R(k)$ and $X_I(k)$ are, respectively, the real and imaginary parts of the kth frequency bin and $j_i$ is the index of the first bin in the ith critical band given by $j_i$={1, 3, 5, 7, 9, 11, 13, 16, 19, 22, 26, 30, 35, 41, 47, 55, 64, 75, 89, 107}.

A calculator 704 computes the energies of the frequency bins in the log domain, $E_{BIN}(k)$, using the following relation:

$$E_{BIN}(k)=X_R^2(k)+X_I^2(k), k=0, \ldots, 127 \tag{5}$$

To compute the spectral mask, the formants in the spectrum need to be located, which is performed by first determining the maxima and minima of the power spectrum of the input sound signal 701 in the log domain.

The calculator 704 determines the energy of each frequency bin in the log domain using the following relation:

$$\mathrm{Bin}(k)=10 \log(0.5(E_{BIN}^{(0)}(k)+E_{BIN}^{(1)}(k))), k=0, \ldots, 127 \tag{6}$$

where $E_{BIN}^{(0)}(k)$ and $E_{BIN}^{(1)}(k)$ are the energy per frequency bin from both spectral analysis. Similarly, the calculator 703 averages the energy of each critical band from the spectral analysis and converted to the log domain.

To simplify the formant search, the spectral mask calculator 213 comprises a low-pass filter 705 to first low-pass filter the energies of the frequency bins in the log domain using the following relation:

$$\mathrm{Bin}_{LP}(n)=0.15\mathrm{Bin}(n-2)+0.15\mathrm{Bin}(n-1)+0.4\mathrm{Bin}(n)+0.15\mathrm{Bin}(n+1)+0.15\mathrm{Bin}(n+2) \tag{7}$$

Figure 4:
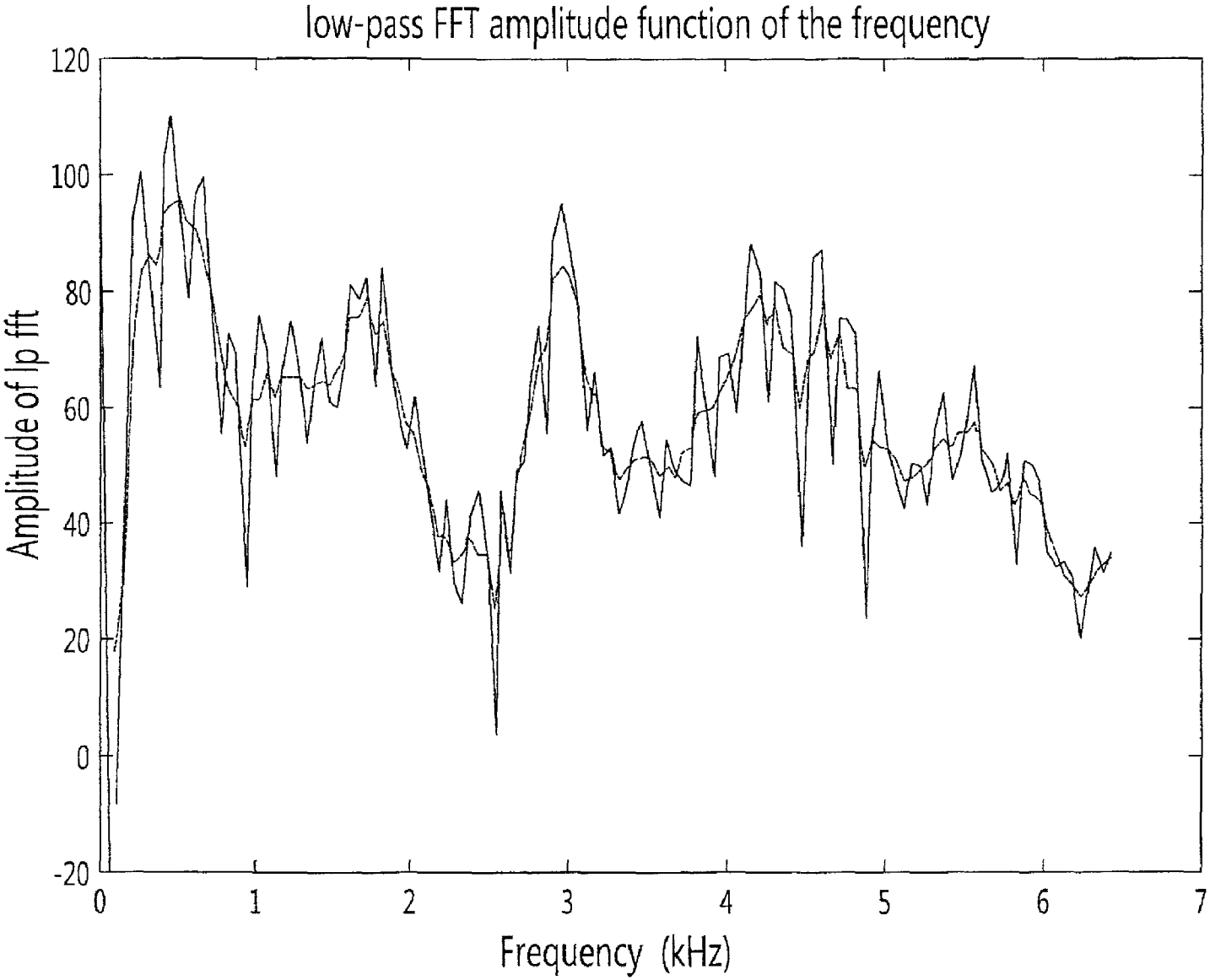
FIG. 4 is a graph showing an example of a log power spectrum before and after low pass filtering.

FIG. 4 is a graph showing an example of a log power spectrum before and after low-pass filtering.

The spectral mask calculator 213 also comprises a maxima and minima finder 706 that computes the maximum dynamic between critical bands in the log domain. The variation of this maximum dynamic between critical bands will be used later as a part of a threshold to determine or not the presence of a maximum or a minimum.

$$\mathrm{Dynamic}_{band}=\max(lg_\mathrm{band}(n)_{n=0}^{n=20})-\min(lg_\mathrm{band}(n)_{n=0}^{n=20}) \tag{8}$$

where $\max(\mathrm{lg_band}(n)_{n=0}^{n=20})$ is the maximum average energy in a critical frequency band, and $\min(\mathrm{lg_band}(n)_{n=0}^{n=20})$ is the minimum average energy in a critical frequency band.

Starting at 1.5 kHz the algorithm used in the maxima and minima finder 706 tries to find the different positions of the maxima and the minima in the power spectrum of the input sound signal 701, i.e. in the low-pass filtered energies of the frequency bins from the low-pass filter 705. The position of a maximum (or a minimum) is found by the maxima and minima finder 706 when the bin is greater than the $2^{nd}$ previous bin and the $2^{nd}$ next bin. This precaution helps to prevent to declare as a maximum (minimum) only local variation.

$$\left.\begin{array}{l} \text{if } (Bin_{LP}(f) > Bin_{LP}(f_{-2}) \,\&\, Bin_{LP}(f) > Bin_{LP}(f_{+2})) \\ \qquad index_{max} = f \\ \text{if } (Bin_{LP}(f) < Bin_{LP}(f_{-2}) \,\&\, Bin_{LP}(f) < Bin_{LP}(f_{+2})) \\ \qquad index_{min} = f \end{array}\right|_{f=bin_{max}}^{f=bin_{min}} \tag{9}$$

Figure 5:
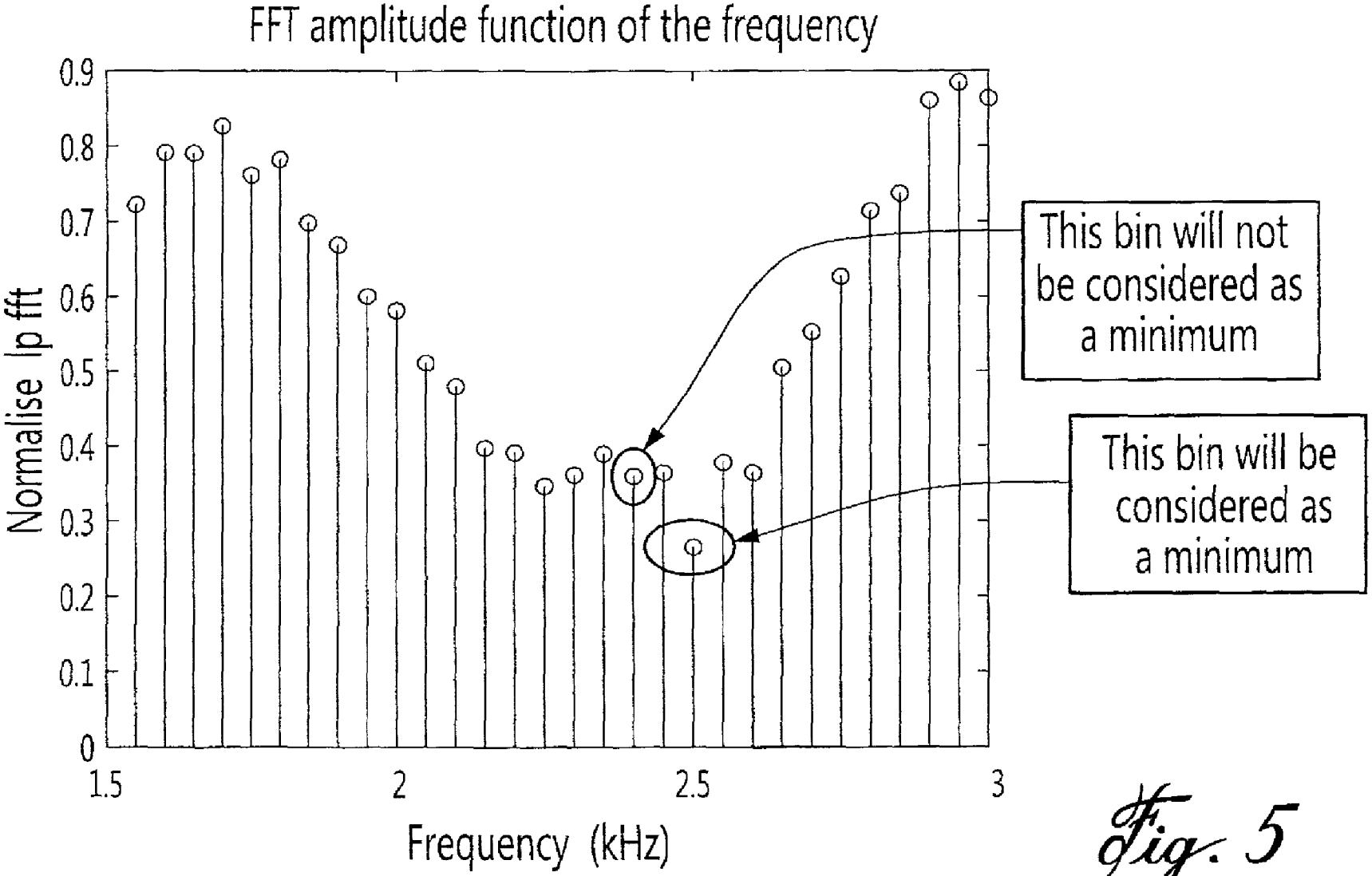
FIG. 5 is a graph illustrating selection of maximum and minimum of the power spectrum.

When a maximum and a minimum are found, the algorithm used in the maxima and minima finder 706 validates that the difference between this maximum and minimum is greater than 15% of the above mentioned maximum dynamic observed between critical bands. If this is the case, two different spectral masks are applied for the maximum and the minimum position as illustrated in FIG. 5.

$$\begin{array}{l} \text{if } (Bin_{LP}(index_{max}) - Bin_{LP}(index_{min}) > 0.15 Dynamic_{band}) \\ Dist_{max_min} = \mathrm{abs}(index_{max} - index_{min}) \\ \text{if}(Dist_{max_min} >= 4) \\ \mathrm{mask}(n) = fac_{min}(n)\,|_{n=(index_{min}-2)}^{n=(index_{min}+2)} \\ \mathrm{mask}(n) = fac_{max}(n)\,|_{n=(index_{max}-2)}^{n=(index_{max}+2)} \\ \text{else} \\ \mathrm{mask}(index_{min} + |1|) = 0.75 \\ \mathrm{mask}(index_{min}) = 0.5 \\ \mathrm{mask}(index_{max} + |1|) = 0.75 \\ \mathrm{mask}(index_{max}) = 1.00 \end{array} \tag{10}$$

The spectral mask calculator 213 finally comprises a spectral mask sub-calculator 707 to determine that the spectral mask in the spectral region corresponding to the maximum has the following values centered at 1.0 on the position of the maximum:

$$fac_{max}[5]=\{0.45,0.75,1.0,0.75,0.45\} \quad (11)$$

The frequency mask sub-calculator 707 determines that the spectral mask in the spectral region corresponding to the minimum has the following value centered at 0.15 on the position of the minimum:

$$fac_{min}[5]=\{0.75,0.35,0.15,0.35,0.75\} \quad (12)$$

The spectral mask of the other frequency bins is not changed and remains the same as the past frame. The idea of not changing the entire spectral mask helps to stabilize the quantized frequency bins. The spectral masks for the low energy frequency bins remain low until a new maximum appears in those spectral regions.

After the above operations, the spectral mask is applied to the MDCT coefficients by the MDCT modifier $\mathbf{217}_1$ in such a manner that the spectral error located around a maximum is nearly not attenuated and the spectral error located around a minimum is pushed down.

Because the resolution of the FFT is only 50 Hz, the MDCT modifier $\mathbf{217}_1$ applies the spectral mask for 1 FFT bin to 2 MDCT coefficients as follow:

$$\begin{aligned} MDCT_{coeff}(2\cdot i) &= \text{mask}(i)\cdot MDCT_{coeff}(2\cdot i) \\ MDCT_{coeff}(2\cdot i+1) &= \text{mask}(i)\cdot MDCT_{coeff}(2\cdot +1) \end{aligned} \Bigg|_{i=(bin_{min})}^{i=(bin_{max})} \quad (13)$$

If more bits are available, it is possible to remove the quantized frequency bins from the $MDCT_{coeff}$ input and quantize in the MDCT quantizer $\mathbf{217}_2$ the new signal or simply quantize the unquantized frequency bins. Depending of the bit rate available for this second stage of quantization, it could be necessary to use a second spectral mask based on the previous spectral mask. The second weighting stage is defined as follow:

$$\begin{aligned} &\text{if } (\text{mask}(i) <= 0.5) \\ &\quad MDCT_{coeff}(2\cdot i) = 0.5\cdot MDCT_{coeff}(2\cdot i) \\ &\quad MDCT_{coeff}(2\cdot i+1) = 0.5\cdot MDCT_{coeff}(2\cdot +1) \Big|_{i=(bin_{min})}^{i=(bin_{max})} \\ &\text{else if } (\text{mask}(i) <= 0.8) \\ &\quad MDCT_{coeff}(2\cdot i) = 1.25\cdot \text{mask}(i)\cdot MDCT_{coeff}(2\cdot i) \\ &\quad MDCT_{coeff}(2\cdot i+1) = 1.25\cdot \text{mask}(i)\cdot MDCT_{coeff}(2\cdot +1) \Big|_{i=(bin_{min})}^{i=(bin_{max})} \end{aligned} \quad (14)$$

Pushing down a lot of the error frequency bins helps to concentrate the available bit rate where the formants are present in the weighted input sound signal. In subjective listening tests, this technique gave a 0.15 improvement in the mean opinion score (MOS), which is a significant improvement.

Figure 8:
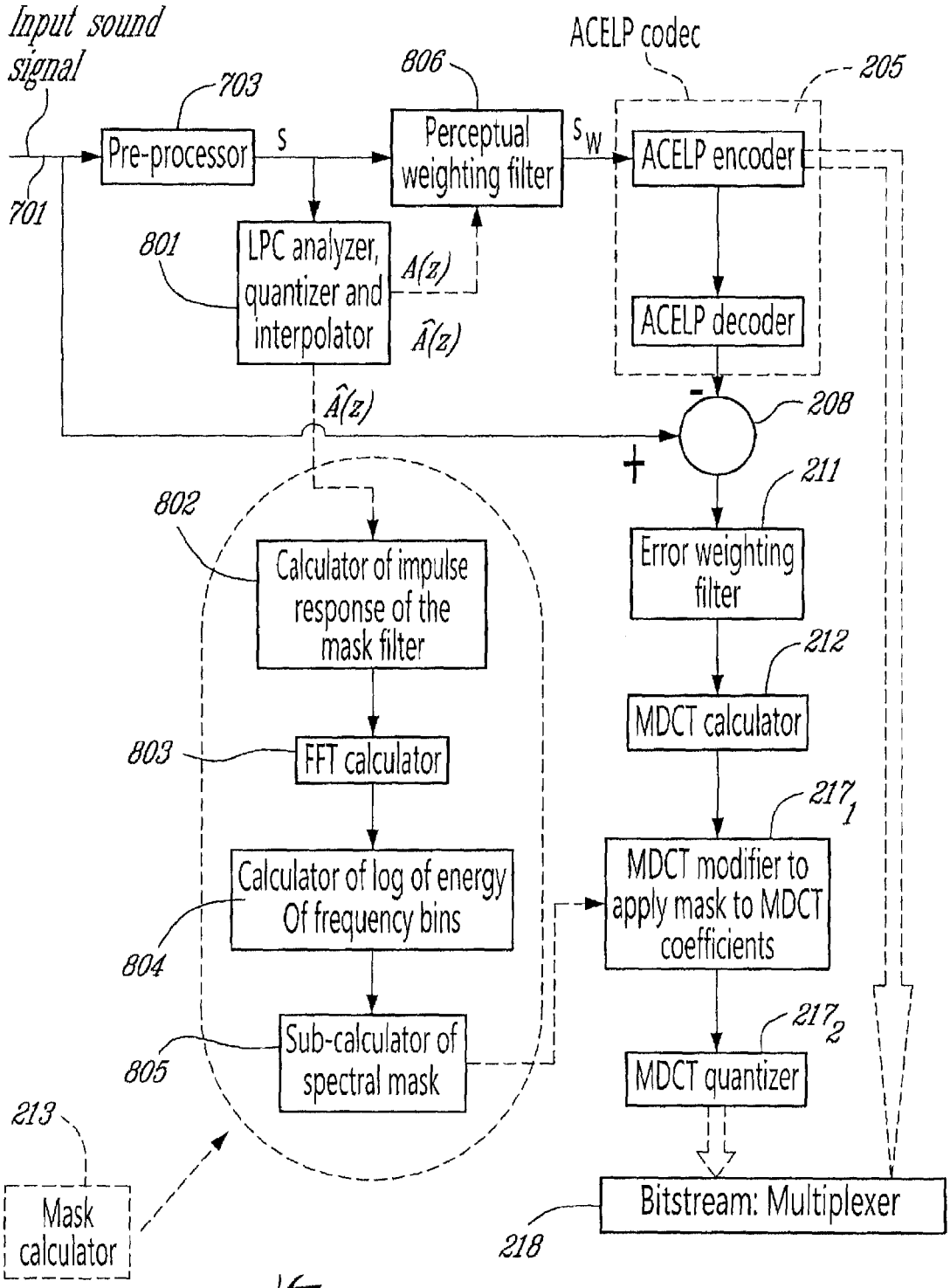
FIG. 8 is a schematic block diagram of a second illustrative embodiment of the technique for calculating and applying a spectral mask to transform coefficients in the upper layers.

Spectral Mask Computation Based on the Impulse Response Related to the Synthesis Filter FIG. 8 is a schematic block diagram of another illustrative embodiment of a method and device for coding an input sound signal in at least one lower layer and at least one upper layer of an embedded codec while reducing a quantization noise, including calculating and applying a spectral mask to transform coefficients in the upper layers. In the block diagram of FIG. 8, the elements corresponding to FIGS. 2 and 7 are identified using the same reference numerals. Also in the block diagram of FIG. 8, a perceptual weighting filter 806 is responsive to LPC coefficients calculated in a LPC analyzer, quantizer and interpolator 801 in response to the pre-processed sound signal from the pre-processor 703 to filter this preprocessed sound signal and supply to the ACELP codec 205 a pre-processed, perceptually weighted sound signal for ACELP coding [1].

As shown in the embodiment of FIG. 7, the spectral mask is computed in a spectral mask calculator 213 so that it has a value around 1 at the formant regions and a value around 0.15 at the inter-formant regions. However, in the EV-VBR codec, a LPC analyzer, quantizer and interpolator 801 already calculates a linear prediction (LP) synthesis filter used in the ACELP lower (or core) layer(s) and already containing information regarding the formant structure, since the synthesis filter models the spectral envelope of the input sound signal 701.

Figure 6:
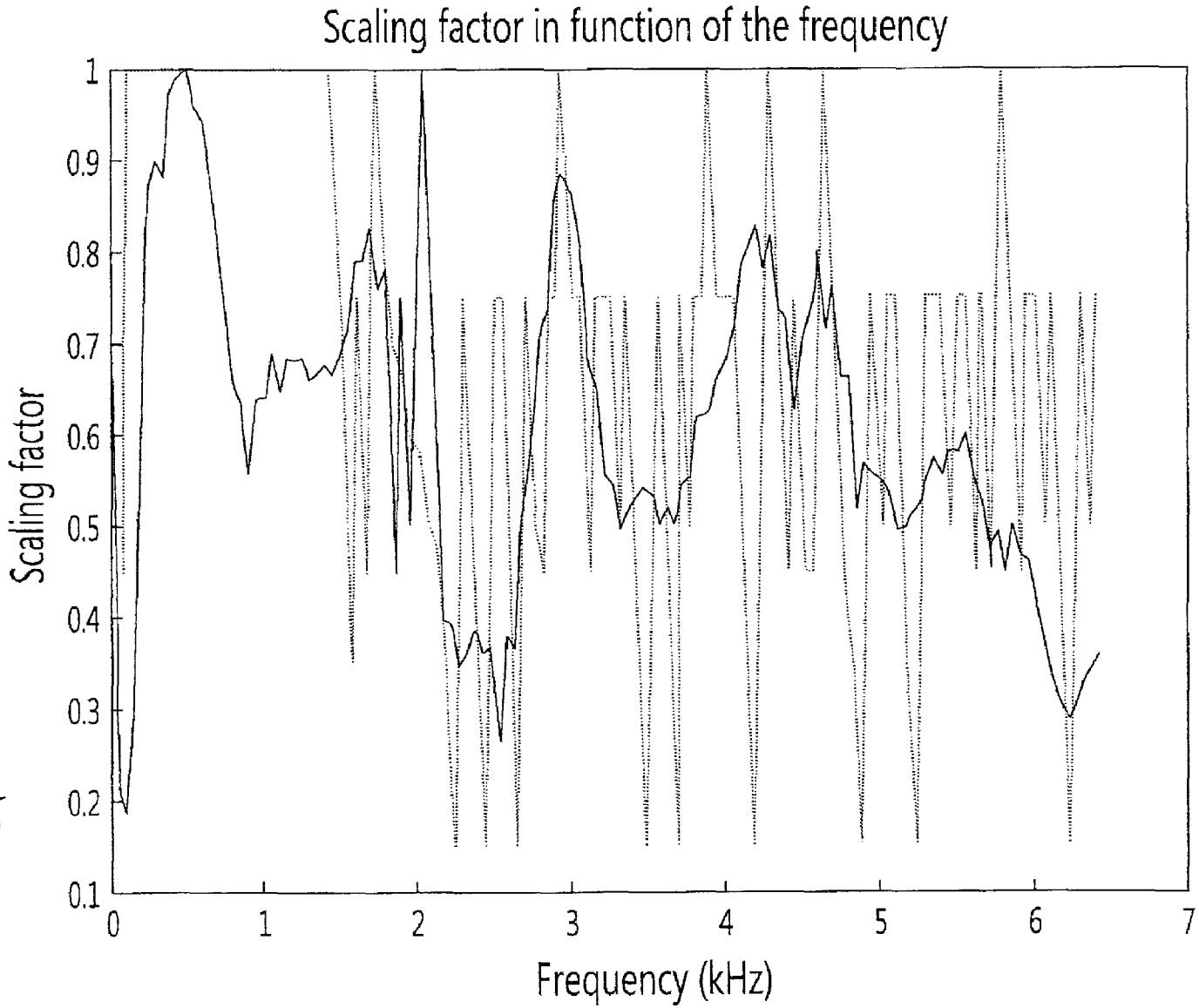
FIG. 6 is a graph illustrating computation of a spectral mask.

In the embodiment of FIG. 8, the spectral mask is computed in mask calculator 213 as follows:

- A calculator 802 derives the impulse response of a mask filter derived from the LP parameters calculated in the LPC analyzer, quantizer and interpolator 801 of FIG. 8. A mask filter similar to the weighted synthesis filter used in CELP codecs can be used.
- A FFT calculator 802 then computes the power spectrum of the mask filter by computing the FFT of the impulse response of the mask filter from calculator 802.
- A calculator 804 then computes the energies of the frequency bins in the log domain using the procedure as described hereinabove with reference to FIG. 7.
- In sub-calculator 805 responsive to the power spectrum of the mask filter from the FFT calculator 802 and the computed energies of the frequency bins in the log domain from calculator 804, the spectral mask can be computed in a manner similar to the approach described above by searching maxima and minima of the power spectrum of the mask filter (FIG. 6).

A simpler approach is to compute the spectral mask as a scaled version of the power spectrum of the mask filter. This can be done by finding the maximum of the power spectrum of the mask filter in the log domain and scaling it such that the maximum becomes 1. The spectral mask then is given by the scaled power spectrum of the mask filter in the log domain. Since the mask filter is derived from the LP filter parameters determined on the basis of the input sound signal 701, the power spectrum of the mask filter is also representative of the power spectrum of the input sound signal 701.

To design the mask filter from which the spectral mask is derived, it is first verified that this filter doesn't exhibit strong spectral tilt. The reason is to have all formants weighted with a value close to 1. In the EV-VBR codec, the LP filter is computed based on a pre-emphasized signal. Thus the filter already doesn't have a pronounced spectral tilt. In a first example, the mask filter is a weighted version of the synthesis filter, given by the relation:

$$H(z)=1/A(z/\gamma) \quad (15)$$

where $\gamma$ is a factor having a value lower than 1. In a second example, the filter is given by the relation:

$$H(z)=A(z/\gamma_2)/A(z) \quad (16)$$

As described above, the power spectrum of the filter H(z) can be found by computing the FFT of the impulse response of the mask filter.

The LP filter in the EV-VBR codec is computed 4 times per 20 ms frame (using interpolation). In this case, the impulse response can be computed in calculator 802 based on the LP filter corresponding to the center of the frame. An alternative implementation is to compute the impulse response for each 5 ms subframe and then average all the impulse responses.

These two alternatives are more efficient on speech content. They can be used in music content too; however, if a mechanism is used in the codec to classify frames as speech or music frames, these two alternative can be inactivated in case of music frames.

Although the present invention has been described hereinabove by way of non-restrictive illustrative embodiments thereof, these embodiments can be modified at will within the scope of the appended claims without departing from the spirit and nature of the subject invention.

REFERENCES

[1] ITU-T Recommendation G.718 "Frame error robust narrowband and wideband embedded variable bit-rate coding of speech and audio from 8-32 kbit/s" Approved in September 2008.

[2] J. D. Johnston, "Transform coding of audio signal using perceptual noise criteria," *IEEE J. Select. Areas Commun.*, vol. 6, pp. 314-323, February 1988.

What is claimed is:

1. A method for coding an input sound signal in at least one lower layer and at least one upper layer of an embedded codec, comprising:

in the at least one lower layer, (a) coding the input sound signal to produce coding parameters, wherein coding the input sound signal comprises producing a synthesized sound signal;

computing an error signal as a difference between the input sound signal and the synthesized sound signal;

calculating a spectrum related to the input sound signal and comprising maxima and minima;

calculating, from the spectrum, a spectral mask structured to lower energy in spectral regions corresponding to the minima of the spectrum;

in the at least one upper layer, (a) coding the error signal to produce coding coefficients, (b) applying the spectral mask to the coding coefficients thereby lowering an energy of the coded error signal in the spectral regions corresponding to the minima of the spectrum, and (c) quantizing the masked coding coefficients, wherein applying the spectral mask to the coding coefficients thereby lowering the energy of the coded error signal in the spectral regions corresponding to the minima of the spectrum reduces a quantization noise produced upon quantizing the coding coefficients.

2. A method for coding an input sound signal as claimed in claim 1, wherein the calculated spectrum is a power spectrum.

3. A method for coding an input sound signal as claimed in claim 1, wherein, in the at least one lower layer, coding the input sound signal comprises linear prediction coding the input sound signal to produce linear prediction coding parameters.

4. A method for coding an input sound signal as claimed in claim 1, wherein, in the at least one upper layer, coding the error signal comprises transform coding the error signal to produce transform coefficients.

5. A method for coding an input sound signal as claimed in claim 1, further comprising:

constructing a bit stream including the at least one lower layer containing the coding parameters produced during coding of the input sound signal and the least one upper layer containing the quantized, masked coding coefficients.

6. A method for coding an input sound signal as claimed in claim 1, wherein the input sound signal is first sampled at a first sampling frequency, and wherein the method further comprises, in the at least one lower layer:

resampling the input sound signal at a second sampling frequency prior to coding the input sound signal; and resampling the synthesized sound signal back to the first sampling frequency after coding the input sound signal and prior to computing the error signal.

7. A method for coding an input sound signal as claimed in claim 1, wherein the spectral mask comprises a set of scaling factors applied to the coding coefficients.

8. A method for coding an input sound signal as claimed in claim 1, wherein the spectral mask comprises a set of scaling factors applied to the coding coefficients and wherein the scaling factors are larger in the spectral regions corresponding to the spectrum maxima and smaller in the spectral regions corresponding to the spectrum minima.

9. A method for coding an input sound signal as claimed in claim 1, wherein calculation of the spectrum comprises applying a discrete Fourier transform to the input sound signal to produce the spectrum.

10. A method for coding an input sound signal as claimed in claim 9, further comprising:

after applying the discrete Fourier transform to the input sound signal, dividing the spectrum into critical frequency bands each comprising a number of frequency bins.

11. A method for coding an input sound signal as claimed in claim 10, further comprising:

determining energies of the frequency bins.

12. A method for coding an input sound signal as claimed in claim 11, further comprising:

low-pass filtering the determined energies of the frequency bins.

13. A method for coding an input sound signal as claimed in claim 12, further comprising:

computing average energies of the critical frequency bands;

calculating a maximum dynamic between critical frequency bands from the average energies of the critical frequency bands; and finding the maxima and minima of the spectrum in response to the low-pass filtered energies of the frequency bins and the maximum dynamic.

14. A method for coding an input sound signal as claimed in claim 1, wherein calculating the spectral mask comprises:

defining a mask filter;

computing a spectrum of the mask filter;

computing energies of frequency bins of the spectrum of the mask filter; and computing the spectral mask in response to the spectrum of the mask filter and the energies of the frequency bins.

15. A method for coding an input sound signal as claimed in claim 1, wherein calculating the spectral mask comprises calculating an updated version of at least one previously calculated spectral mask.

16. A device for coding an input sound signal in at least one lower layer and at least one upper layer of an embedded codec, comprising:

in the at least one lower layer, (a) means for coding the input sound signal to produce coding parameters, wherein the input sound signal coding means produces a synthesized sound signal;

means for computing an error signal as a difference between the input sound signal and the synthesized sound signal;

means for calculating a spectrum related to the input sound signal and comprising maxima and minima;

means for calculating, from the spectrum, a spectral mask structured to lower energy in spectral regions corresponding to the minima of the spectrum;

in the at least one upper layer, (a) means for coding the error signal to produce coding coefficients, (b) means for applying the spectral mask to the coding coefficients thereby lowering an energy of the coded error signal in the spectral regions corresponding to the minima of the spectrum, and (c) means for quantizing the masked coding coefficients, wherein applying the spectral mask to the coding coefficients thereby lowering the energy of the coded error signal in the spectral regions corresponding to the minima of the spectrum reduces a quantization noise produced upon quantizing the coding coefficients.

17. A device for coding an input sound signal in at least one lower layer and at least one upper layer of an embedded codec, further comprising:

in the at least one lower layer, (a) a sound signal codec for coding the input sound signal to produce coding parameters, wherein the sound signal codec produces a synthesized sound signal;

a subtractor for computing an error signal as a difference between the input sound signal and the synthesized sound signal;

a calculator of a spectrum related to the input sound signal and comprising maxima and minima;

a calculator of a spectral mask from the spectrum related to the input sound signal, the spectral mask being structured to lower energy in spectral regions corresponding to the minima of the spectrum;

in the at least one upper layer, (a) a coder of the error signal to produce coding coefficients, (b) a modifier of the coding coefficients by applying the spectral mask to the coding coefficients thereby lowering an energy of the coded error signal in the spectral regions corresponding to the minima of the spectrum, and (c) a quantizer of the masked coding coefficients, wherein applying the spectral mask to the coding coefficients thereby lowering the energy of the coded error signal in the spectral regions corresponding to the minima of the spectrum reduces a quantization noise produced upon quantizing the coding coefficients.

18. A device for coding an input sound signal as claimed in claim 17, wherein the calculated spectrum is a power spectrum.

19. A device for coding an input sound signal as claimed in claim 17, wherein, in the at least one lower layer, the sound signal codec for coding the input sound signal comprises a linear prediction sound signal coder to produce linear prediction coding parameters.

20. A device for coding an input sound signal as claimed in claim 17, wherein, in the at least one upper layer, the coder of the error signal comprises a transform calculator to produce transform coefficients.

21. A device for coding an input sound signal as claimed in claim 17, comprising a multiplexer for constructing a bit stream including the at least one lower layer containing the coding parameters produced during coding of the input sound signal and the least one upper layer containing the quantized, masked coding coefficients.

22. A device for coding an input sound signal as claimed in claim 17, wherein the input sound signal is first sampled at a first sampling frequency, and wherein the device further comprises, in the at least one lower layer:

a resampler of the input sound signal at a second sampling frequency prior to coding the input sound signal; and a resampler of the synthesized sound signal back to the first sampling frequency after coding the input sound signal and prior to computing the error signal.

23. A device for coding an input sound signal as claimed in claim 17, wherein the spectral mask comprises a set of scaling factors applied to the coding coefficients.

24. A device for coding an input sound signal as claimed in claim 17, wherein the spectral mask comprises a set of scaling factors applied to the coding coefficients and wherein the scaling factors are larger in the spectral regions corresponding to the spectrum maxima and smaller in the spectral regions corresponding to the spectrum minima.

25. A device for coding an input sound signal as claimed in claim 17, wherein the spectrum calculator applies a discrete Fourier transform to the input sound signal to produce the spectrum.

26. A device for coding an input sound signal as claimed in claim 25, wherein the spectrum calculator, after having applied the discrete Fourier transform to the input sound signal, divides the spectrum into critical frequency bands each comprising a number of frequency bins.

27. A device for coding an input sound signal as claimed in claim 26, further comprising:

a calculator of energies of the frequency bins.

28. A device for coding an input sound signal as claimed in claim 27, wherein the spectral mask calculator comprises a low-pass filter for low-pass filtering the energies of the frequency bins.

29. A device for coding an input sound signal as claimed in claim 28, further comprising:

a calculator of average energies of the critical frequency bands and of a maximum dynamic between critical bands from the average energies of the critical frequency bands;

wherein the spectral mask calculator comprises a finder of the maxima and minima of the spectrum in response to the low-pass filtered energies of the frequency bins and the maximum dynamic.

30. A device for coding an input sound signal as claimed in claim 17, wherein the spectral mask calculator comprises:

a calculator of a spectrum of a pre-defined mask filter;

a calculator of energies of frequency bins of the spectrum of the mask filter; and a sub-calculator of the spectral mask in response to the spectrum of the mask filter and the energies of the frequency bins.

31. A device for coding an input sound signal as claimed in claim 17, wherein the calculator of the spectral mask computes an updated version of at least one previously calculated spectral mask.

* * * * *